United States Patent [19]

Hanafi

[11] Patent Number: 4,616,983

[45] Date of Patent: Oct. 14, 1986

[54] PISTON OR PLUNGER PUMP

[75] Inventor: Nabil Hanafi, Bad Urach, Fed. Rep. of Germany

[73] Assignee: Uraca Pumpenfabrik GmbH & Co. KG, Bad Urach, Fed. Rep. of Germany

[21] Appl. No.: 697,348

[22] Filed: Feb. 1, 1985

[30] Foreign Application Priority Data

Feb. 9, 1984 [DE] Fed. Rep. of Germany ..... 3404520

[51] Int. Cl.[4] ..... F04B 21/02; F16J 10/02

[52] U.S. Cl. ..... 417/571; 417/539; 92/171

[58] Field of Search ..... 92/171; 417/454, 571, 417/539

[56] References Cited

U.S. PATENT DOCUMENTS

| | | | |
|---|---|---|---|
| 2,981,575 | 4/1961 | Leman | 92/171 |
| 3,008,429 | 11/1961 | Stahl et al. | 92/171 |
| 3,238,892 | 3/1966 | Coberly et al. | 417/454 |
| 3,309,014 | 3/1967 | Bauer et al. | 417/571 |
| 3,370,545 | 2/1968 | Waibel | 417/571 |
| 3,413,929 | 12/1968 | Cook et al. | 92/171 |
| 3,508,849 | 4/1970 | Weber | 417/454 |
| 3,510,233 | 5/1970 | Strebel et al. | 92/171 |

FOREIGN PATENT DOCUMENTS

| | | | |
|---|---|---|---|
| 1911534 | 9/1970 | Fed. Rep. of Germany | 417/454 |
| 1728243 | 5/1977 | Fed. Rep. of Germany . | |

*Primary Examiner*—William L. Freeh

*Attorney, Agent, or Firm*—Michael J. Striker

[57] ABSTRACT

A pumped medium supplied to a suction chamber of the pump is first introduced under the action of the plunger into a working chamber of the plunger and then into a pressure chamber and a subsequent pressure line. The seats of a suction valve and of a discharge valve are arranged on a housing of a central valve, which can be inserted into a cylinder head through an opening formed in a cylinder head which can be closed by means of a base part. A piston-like element which is provided with intermediate seals between the base part and the central valve housing serves to secure the position of the central valve housing. The piston-like element is acted on at both its end faces, due to the provision of spacing chambers, by the pressure of the pumped medium in the pressure chamber. The seals are wedge-shaped so that they are increasingly urged radially outwardly against the cylinder head under axial loading.

13 Claims, 1 Drawing Figure

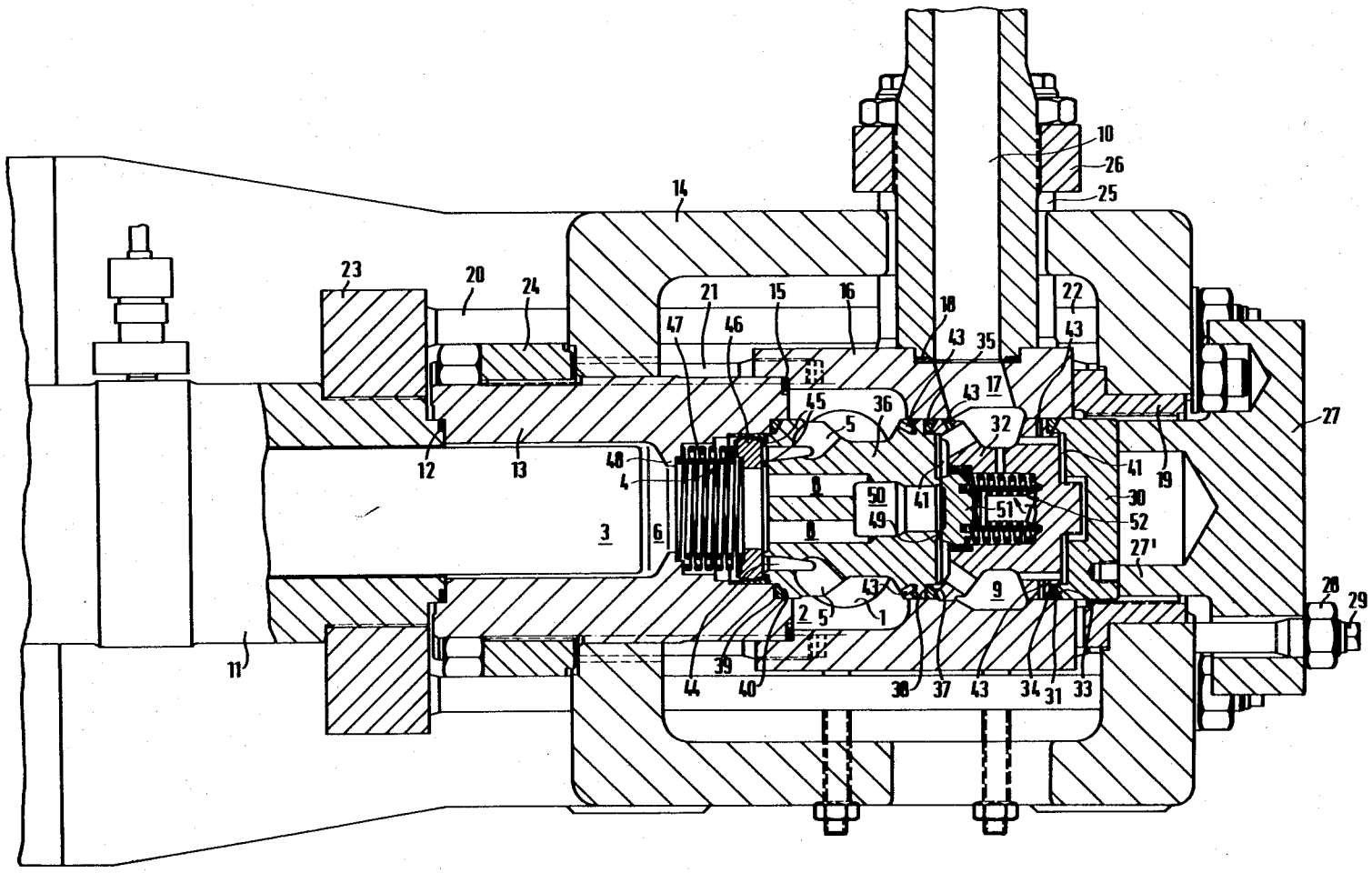

PISTON OR PLUNGER PUMP

BACKGROUND OF THE INVENTION

The invention relates to a piston or plunger pump comprising at least one piston or plunger; a cylinder part coaxial thereto which accommodates a working chamber of the piston or plunger; a cylinder head which accommodates a cyindrical pressure chamber which is coaxially disposed relative to the piston or plunger and is connected to a pressure line; and a central valve housing which is axially arranged between the working chamber of the piston or plunger and the pressure chamber, which is sealed relative to the cylinder part and also the cylinder head by means of seals and which has seats for suction and discharge valves arranged at its end faces, at least one axial passage controlled by the discharge valve and also a suction passage extending from its peripheral surface to the suction valve side end surface and controlled by the suction valve.

Pumps of this type of construction, which is, for example known from DE-AS No. 17 28 243, fundamentally offer favourable preconditions for the construction of a high pressure pump which makes it possible to generate or to maintain a very high pressure difference, for example 1000 bar. This originates from the fact that the working chamber for the piston or plunger which is subjected to extremely strong pulsations is provided in the form of a cylindrical bore in the cylinder part which is formed as a tubular part without radial openings which penetrate the cylindrical bore and which can therefore be loaded to a particularly high degree, also with respect to pulsating pressures.

The central valve housing is admittedly also subjected to strong pressure pulses when the pumped medium is thrust, during the pressure stroke of the piston or plunger, from the working chamber of the piston or plunger through the axial passage of the central valve housing into the pressure chamber, with the central valve housing being—theoretically—less resistant to pulsations because of its comparatively complicated shape. However, this lower degree of loadability cannot in practice lead to any form of breakdown because the pump valves, and thus also the central valve body which has the valve seats, are parts subject to wear which must in any event be exchanged from time to time.

In the pumps set forth in DE-AS No. 17 28 243 the exchanging of the valves is, however, made exceptionally difficult because the cylinder head, which in DE-AS No. 17 28 243 also accommodates the suction lines of the pump, surrounds the pressure chamber without a joint as a unitary part in such a way that the pressure chamber only needs to be sealed against the outside, or against the suction side of the pump, by a single high pressure seal arranged between the cylinder head and the central valve housing. Thus the advantage of being able to seal the pressure chamber by means of a single seal is bought with the disadvantage that the entire valve head must be dismantled in order to exchange the pump valves.

SUMMARY OF THE INVENTION

Accordingly, it is an object of the invention to develop a pump of the initially named type in such a way that the pump valves can be easily interchanged without impairing the sealed state of the pressure chamber or pump working chamber. Simultaneously it should be ensured that the seals which may be necessary do not execute any scrubbing movements relative to the cylinder part and/or cylinder head under pressure pulsations during the operation of the pump which could roughen the surfaces on the cylinder head or cylinder part, and which could lead to premature leakages, so that the cylinder part or cylinder head have to be exchanged prematurely.

This problem is solved in that the central valve housing can be inserted through an end face opening of the cylinder head and can be secured by means of a base part which closes the opening and which can be sealed relative to the cylinder part and the cylinder head, by the base part axially clamping the central valve housing against the cylinder part, or against the seal that is arranged there, and by means of a piston-like part which can be inserted into the pressure chamber and which is acted on at its two end faces by the pressure of the pump medium in the pressure chamber, and by the base part pressing ring seals, which are arranged between the piston-like part and the base part. The central valve housing may be provided with peripheral grooves formed between the respective parts and receiving the seals to transmit the axial clamping forces, radially outwardly against the wall of the pressure chamber while deforming them.

Thus, in accordance with the invention, the ring seals between the piston-like part and the central valve housing respectively are biased in the radial direction under the axial clamping forces which act on them, so that the piston-like part and the central valve housing are supported at the seals both in the axial and in a the radial direction in force-locked manner on the cylinder head. As the piston-like part is acted on by the pressure of the pumped medium in the pressure chamber on its two end faces, which have the same cross-section, the hydraulic (or pneumatic) forces which act on the piston-like part in the axial direction of the latter cancel each other to a large degree so that the piston-like part does not try to execute pulsating movements despite the pulsations of the pumped medium, which occur in the pressure chamber. Accordingly the ring seals also do not suffer any blows in the axial direction through the piston-like part.

On the whole the ring seals are thus able to seal exceptionally high pressures without executing scrubbing movements on the surface of the cylinder head which faces them. Accordingly, no damage need be feared at the surfaces of the cylinder head, which are acted on by the pumped medium. Such damage could otherwise rapidly develop under the influence of the pumped medium, in particular when pumping strongly corrosive media. Thus, the invention also prevents the cylinder head from having to be prematurely exchanged. This is particularly important because the cylinder head has to be manufactured of very expensive material in view of a high pressure loading, and possibly also of particularly corrosion resistant material (when pumping strongly corrosive media), and thus at high cost.

In accordance with a preferred embodiment of the invention the seal may be arranged between the central valve housing and the cylinder part on an annular step at an end face of the cylinder part, and be pressed radially outwardly against the peripheral edge of the step under the axial clamping of the central valve housing. Thus both the peripheral surface of the seal which is pressed against the peripheral edge of the annular step, and also its end face which faces the cylinder part and which contacts the annular step, contribute to the axial support of the central valve housing, which accordingly adopts a particularly secure position, even at the highest pressure differentials which are present at the pressure and suction side of the central valve housing, in particular during the suction stroke of the piston or plunger. Accordingly the central valve housing cannot bring about any scrubbing movements at the cylinder head or cylinder part of the seals which serve to support it.

In the gaps which are formed between adjoining components as a result of the design, for example between the central valve housing or the piston-like part and the cylinder head, there is formed, as a rule, so-called dead water, i.e. the pumped medium which penetrates into the gaps is not exchanged, or only over comparatively long periods of time. On pumping aggressive or corrosive pump media the dead water leads as a rule to an undesired and, under certain circumstances, relatively rapidly progressing gap corrosion which can only be avoided with difficulty by the use of very resistant materials. This is made more difficult by the fact that the aggressiveness or corrosiveness of the dead water generally increases in the course of time, when the portions of gaseous substances dissolved in the pumped medium progressively decrease in the dead water. In order to effectively prevent this gap corrosion measures are taken, in accordance with the invention, to ensure medium exchange in the gaps. For this purpose cut-outs, for example in the form of grooves or bores, are arranged in at least one of the components which bound the respective gap. The deeper zones of the gap communicate via these cut-outs with the chambers which adjoin the open side of the gap and which contain hydraulic or pumped medium which is continuously exchanged. This arrangement promotes the exchange of medium between the gaps and the chambers via the cut-outs. More specifically, the invention exploits the weak pulsation movements of the components relative to one another, which occur under pressure pulsations of the pump. These relative movements of the components alternately generate weak excess pressure and reduced pressure in the gaps which brings about the desired exchange of medium in the gaps via the above named cut-outs. Thus it is possible, in accordance with the invention, to fit adjoining parts on or into one another with the highest accuracy so that narrow gap cross-sections can be permitted, which meets the desire for an accurate fit. Such narrow gaps were previously undesired when pumping aggressive or corrosive media because of the danger of dead water formation.

The described formation of the gaps can fundamentally be used anywhere in fluid or hydraulic systems which are subjected to pulsation, and is thus not in any way restricted to pumps or the like. However, the described formation of the gaps is particularly advantageous and expedient in pumps, in particular in the highest pressure pumps for conveying aggressive and corrosive media, because here the strong pressure pulsations contribute to a particular effective medium exchange and particular significance is attributed to the prevention of gap corrosion, because the pump components have to be manufactured from extremely expensive material and also with the greatest care having regard to high pressure pulsations and also to the aggressiveness of the pumped medium. It is thus of considerable significance in regard to the maintenance costs and to the availability of the pump, if gap corrosion can be avoided.

In a preferred embodiment of the plunger pump of the invention the ring seals between the piston-like part and the base part and between the piston-like part the central valve housing and the seal between the central valve housing and the cylinder part may be of wedge-shaped or trapezoidal cross-section with a cross-section which increases axially in the radial outward direction.

A favoured arrangement is characterised in that a cylindrical tubular part, which can be closed at one of its end faces by the base part, is provided as the cylinder head, with the cylindrical tubular part being axially braced at the other end face on the cylinder part by means of an intermediate seal and surrounding a suction chamber which surrounds the central valve body in ring-like manner and which is connectable with a suction line.

In a particularly preferred embodiment the piston-like part may be constructed as a spring housing for a coil spring arrangement of the discharge valve which acts on the valve body to close it. The annular valve body of the suction valve is acted on in the closing direction by means of a coil spring arrangement which is braced against a spring abutment formed by an annular web arranged in the cylinder part.

Further preferred features of the invention are set forth in the claims and will be discussed in the following having regard to the drawing in which a particularly preferred embodiment of the invention is shown.

BRIEF DESCRIPTION OF THE DRAWING

The single FIGURE shows a partly sectioned view of the pump in the axial direction of a non-illustrated crank shaft.

DETAILED DESCRIPTION OF THE PREFERRED EMBODIMENTS

A pumped medium enters via a suction line 1 into a suction chamber 2 from which it is conveyed during the suction stroke, under the action of a plunger 3, in known manner through suction passages 5 controlled by a suction valve 4, into a working chamber 6 for the plunger and then, during the pressure stroke, through outlet passages 8 controlled by a pressure or discharge valve 7 into the pressure chamber 9 and also into a subsequent pressure line 10.

The plunger 3 is displaceably mounted in a cylinder part 11 which surrounds it and which also accommodates plunger seals which are not shown. The cylinder part 11 is clamped through the intermediary of a seal 12 against a further cylinder part 13 which accomodates the working chamber 6 for the plunger. The further cylinder part 13 projects through a correspondingly shaped opening in a cylinder head housing 14 into the inner chamber of the cylinder head housing 14. The opening in the cylinder head housing 14 accommodates the axially displaceable cylinder part 13.

The cylinder part 13 is axially clamped through the intermediary of an annular cylinder head seal 15 against a substantially tubular cylinder head part 16 which is arranged within the cylinder head housing 14, so that pulsations, which the cylinder part 13 executes during the operation of the plunger 3, in correspondence with the pressure pulsations in the working chamber 6 for the plunger, are not transmitted to the cylinder head part 16, or are only transmitted thereto after substantial attenuation.

The cylinder head part 16 has a relatively thin-walled portion which surrounds the suction chamber 2 and also a thick-walled region which adjoins the thin-walled region while forming an annular step, which surrounds the pressure chamber 9 and which is connected with the pressure line 10 via a bore 17 which is slightly inclined to the axis of the cylinder head part 16. The pressure line 10 is axially clamped against the cylinder head part 16 through the intermediary of a seal 18. The seal 18 is accommodated in an annular step-like recess which is arranged at the outer side of the cylinder head part 16 and which adjoins the outward end of the bore 17.

The cylinder head part 16 is clamped against a flange-like end face of a sleeve 19 which is inserted into the wall of the cylinder housing 14 facing the cylinder part 13.

The cylinder parts 11 and 13, the cylinder head part 16 and also the sleeve 19 with the cylinder head housing 14 are mechanically held together by threaded studs 20 to 22 which are tensioned in the illustrated manner between a ring 23 which is threaded onto the outside of the cylinder part 11 and the remoter transverse wall of the cylinder head housing 14, between the cylinder head part 16 and a ring 24 which is threaded onto the cylinder part 13, and between the cylinder head part 16 and also the transverse wall of the cylinder head 14 which accommodates the sleeve 19. The pressure line 10 is attached in corresponding manner by means of studs 25 which are tensioned between the cylinder head part 16 and a ring 26 which is threaded onto the pressure line 10.

A cover part 27 is arranged in the opening of the cylinder head housing 14 formed by the sleeve 19 and is inserted into the sleeve 19 by means of a projection 27' which is hollowed out by a blind bore. The cover part 27 can be axially clamped to a greater or lesser degree against a base part 30 which is supported at the projection 27' by appropriate tightening of nuts 28 which are arranged at the cylinder head housing 24 on bolts 29. The base part 30 has the task of closing the confronting end face opening of the cylinder head part 16 or of the pressure chamber 9.

For this purpose the base part 30 is axially clamped through the intermediary of a ring seal 31 against a piston-like part 32 which can be inserted through the opening closed by the base part 30 into the pressure chamber 9. The ring seal 31 has a wedge-shaped cross-section with an axial dimension which increases in the radial outward direction and is arranged in an annular groove of corresponding cross-section, which is formed between a conical annular surface 33 of the base part 30 and an annular step-like formation 34 on the piston-like part 32.

The piston-like part 32 is axially clamped through the intermediary of a ring seal 35 against a central valve housing 36 which is formed as a piston-like part, in just the same way as the piston-like part 32, and which can be inserted into the cylinder head part 16 through the opening of the cylinder head part 16 which is closed by the base part 30.

The ring seal 35 is constructed identically to the ring seal 31 and is arranged in an annular groove which is formed between a conical annular surface 37 on the piston-like part 32 and an annular step-like formation 38 on the central valve housing 36.

The central valve housing 36 is in turn biased through the intermediary of an annular seal 39 against an annular step of the cylinder part 13, with the ring seal 39 again being similar to the ring seal 35 and contacting a conical annular surface 40 of the central valve housing 36. As a result of the illustrated arrangement when the nuts 28 are tightened, and the cover part 27 thereby exerts an increasing axial pressure on the base part 30, the ring seals 31, 35 and 39 are increasingly biased radially outwardly against the cylinder head part 16 and the cylinder part 13, respectively.

This ensures, in addition to good sealing, a particularly good support of the piston-like part 32 and also of the central valve housing 36 relative to the cylinder head part 16 and the cylinder part 13 respectively.

Spacing chambers 41 of the same cross-section are left at the two end faces of the piston-like part 32 relative to the base part 30 and the central valve housing 36, respectively. These spacing chambers 41 are connected via bores in the piston-like part 32 with the pressure chamber 9, or with an annular chamber which forms the pressure chamber 9 and which is formed by a peripheral ring-like recess in the piston-like part 32. As a result of this arrangement the forces of the pumped medium which act in the axial direction on the piston-like part 32 mutually cancel each other. This has the advantage that the axial thrust which is transmitted from the base part 30 via the ring seal 31 to the piston-like part 32 is transmitted to the ring seal 35 without reduction by the hydraulic or pneumatic forces. Accordingly the nuts 28 only need to be tightened comparatively weakly in order to urge the ring seals 31, 35 and 39 radially outwardly with sufficient force, i.e. overloading of the ring seals 31, 35 and 39 during assembly as a result of axial stresses, which are too high, need not be feared.

In order to facilitate, if necessary, the medium exchange at the annular gaps between the piston-like part 32 or the central valve housing 36 and the cylinder head part 16 in the vicinity of the ring seals 31 and 35 it is possible to provide flushing bores 43 in the piston-like part 32, and/or in the central valve housing 36, which better connect the annular gaps with the pressure chamber 9 and the suction chamber 2, which surrounds the central valve housing 36 in ring-like manner, respectively. An increased medium exchange of this kind can be advantageous, particularly when forwarding strongly corrosive media because the residues formed by these media often give rise to an increased danger of corrosion. Such residues can be avoided by the flushing bores 43, so that pronounced corrosion can also not occur in the region of the ring seals 31, 35 and 39 to which access is difficult. Apart from the fact that corrosion effects can lead to leakages they can also form the starting point for stress cracking in highly loaded parts, and stress cracking can in turn cause fatigue failures.

Alternatively, or additionally, flushing bores 43 can also be provided in the cylinder head part 16. In other respects cut-outs at the walls of the annular gaps can serve for medium exchange in the gaps in place of bores.

The central valve housing 36 has an annular groove 44 at its end face which faces the plunger 3. The groove 44 extends into the suction passages 5 which are connected with the groove 44. The groove 44 is arranged between ring-like seating surfaces 45 which in turn cooperate with the annular valve body 46 of the suction valve 4. The valve body 46 is urged in the closing direction of the suction valve 4 by means of a spring arrangement 47, which consists of two coaxially arranged coil springs. The spring arrangement 47 is braced on an annular web 48 within the cylinder part 13.

On the side facing the pressure chamber 9 the central valve body 36 has an annular seating surface 59 which is formed by an an annular web and which surrounds the central outlet 50 of the outlet passages 8 at the pressure chamber side and cooperates with a plate-like valve body 51 of the discharge valve 7. The valve body 51 is urged in the closing direction by means of a spring arrangement 52 consisting of two coaxially arranged coil springs. The spring arrangement 52 is arranged within the piston-like part 32 which is constructed as a spring housing, with the space which accommodates the spring arrangement 52 being connected with the pressure chamber 9 via a radial bore in the piston-like part 32 in order to hydraulically or pneumatically relieve the rear side of the valve body 51.

It will be understood that each of the elements described above, or two or more together, may also find a useful application in other types of plunger pumps differing from the types described above.

While the invention has been illustrated and described as embodied in a plunger pump, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A plunger pump, comprising at least one plunger; a cylinder part coaxial thereto and accommodating a working chamber for the plunger; a cylinder head which has a cylindrical pressure chamber filled with a pump medium and which is coaxially disposed relative to the plunger and is connected to a pressure line; a central valve housing which has end faces and is axially positioned between the working chamber of the plunger and the pressure chamber, said valve housing being sealed relative to the cylinder part and also the cylinder head by means of seals and having seats; a suction valve and a discharge valve arranged at said end faces on said seats, said valve housing having at least one axial passage controlled by the discharge valve and a suction passage extending from a peripheral surface of the valve housing to a suction valve side end surface thereof and controlled by the suction valve, the central valve housing being inserted through an end face opening formed in an end face of the cylinder head remote from the plunger into the cylinder head; a base part which closes said opening and secures said valve housing, said valve housing being sealed relative to the cylinder part and the cylinder head by the base part which axially clamps the central valve housing against the cylinder part; a piston-like part which has two end faces and is inserted into the pressure chamber and which is acted on at its two end faces by the pressure of the pump medium in the pressure chamber; said end faces having similar cross-section whereby fluid forces acting on said end faces cancel each other to a large degree; and base part pressing ring seals, which are arranged between the piston-like part and the base part and also the central valve housing in peripheral grooves formed between the respective parts to transmit axial clamping forces radially outwardly against a wall of the pressure chamber while deforming said seals.

2. A plunger pump in accordance with claim 1, wherein the cylinder head is a cylindrical tubular part which is closed at one of the end faces thereof by the base part, the cylindrical tubular part being axially braced at the other end face on the cylinder part by means of an intermediate seal and surrounding the suction chamber which annularly surrounds the central valve housing and which is connectable with a suction line.

3. A plunger pump in accordance with claim 1, wherein the piston-like part includes a spring housing, said discharge valve including a valve body and a coil spring arrangement which acts on the valve body to close it and is accommodated in said spring housing.

4. A plunger pump in accordance with claim 1, wherein the suction valve has a coil spring arrangement and an annular valve body which is acted on in a closing direction by said coil spring arrangement which is braced against an annular web provided on the cylinder part and operating as a spring abutment.

5. A plunger pump in accordance with claim 1, wherein peripheral grooves are formed in said piston-like part and in said base part to receive said pressing ring seals, respectively.

6. A plunger pump in accordance with claim 1, wherein said cylinder part has an end face annular step, and a further seal is arranged between the central valve housing and the cylinder part on said end face annular step and is pressed radially outwardly against a peripheral edge of said step under an axial clamping of the central valve housing.

7. A plunger pump in accordance with claim 6, wherein the ring seals between the piston-like part and the base part and the central valve housing and the further seal between the central valve housing and the cylinder part are each wedge-shaped, and each having a cross-section which increases in a radial outward direction.

8. A plunger pump in accordance with claim 2, wherein the ring seals between the piston-like part and the base part and the central valve housing and the further seal between the central valve housing and the cylinder part are each of trapezoidal cross-section and each having a cross-section which increases in a radial outward direction.

9. A plunger pump in accordance with claim 1, wherein cut-outs are formed in the piston-like part, in the central valve housing and in the cylinder head part and lead to said seals in order to facilitate an exchange of pump medium in annular gaps which are formed on a pressure side of the seals between a peripheral wall of the piston-like part and the cylinder head part and on a low pressure side between the peripheral surface of the central valve housing and the cylinder head and the cylinder part.

10. A plunger pump in accordance with claim 9, wherein said cut-outs are housing bores formed in the piston-like part and in the central valve housing.

11. A plunger pump, comprising at least one plunger; a cylinder part coaxial thereto and accommodating a working chamber for the plunger; a cylinder head which has a cylindrical pressure chamber filled with a pump medium and which is coaxially disposed relative to the plunger and is connected to a pressure line; a central valve housing which has end faces and is axially positioned between the working chamber of the plunger and the pressure chamber, said valve housing being sealed relative to the cylinder part and also the cylinder head by means of seals and having seats; a suction valve and a discharge valve arranged at said end faces on said seats, said valve housing having at least one axial passage controlled by the discharge valve and a suction passage extending from a peripheral surface of the valve housing to a suction valve side end surface thereof and controlled by the suction valve, the central valve housing being inserted through an end face opening formed in an end face of the cylinder head remote from the plunger into the cylinder; a base part which closes said opening and secures said valve housing, said valve housing being sealed relative to the cylinder part and the cylinder head by the base part which axially clamps the central valve housing against the cylinder part; a piston-like part which has two end faces and is inserted into the pressure chamber and which is acted on at its two end faces by the pressure of the pump medium in the pressure chamber; and base part pressing ring seals, which are arranged between the piston-like part and the base part and also the central valve housing in peripheral grooves formed between the respective parts to transmit axial clamping forces radially outwardly against a wall of the pressure chamber while deforming said seals, the piston-like part including a spring housing, said discharge valve including a valve body and a coil spring arrangement which acts on the valve body to close it and is accommodated in said spring housing.

12. A plunger pump, comprising at least one plunger; a cylinder part coaxial thereto and accommodating a working chamber for the plunger; a cylinder head which has a cylindrical pressure chamber filled with a pump medium and which is coaxially disposed relative to the plunger and is connected to a pressure line; a central valve housing which has end faces and is axially positioned between the working chamber of the plunger and the pressure chamber, said valve housing being sealed relative to the cylinder part and also the cylinder head by means of seals and having seats; a suction valve and a discharge valve arranged at said end faces on said seats, said valve housing having at least one axial passage controlled by the discharge valve and a suction passage extending from a peripheral surface of the valve housing to a suction valve side end surface thereof and controlled by the suction valve, the central valve housing being inserted through an end face opening formed in an end face of the cylinder head remote from the plunger into the cylinder head; a base part which closes said opening and secures said valve housing, said valve housing being sealed relative to the cylinder part and the cylinder head by the base part which axially clamps the central valve housing against the cylinder part; a piston-like part which has two end faces and is inserted into the pressure chamber and which is acted on at its two end faces by the pressure of the pump medium in the pressure chamber; and base part pressing ring seals, which are arranged between the piston-like part and the base part and also the central valve housing in peripheral grooves formed between the respective parts to transmit axial clamping forces radially outwardly against a wall of the pressure chamber while deforming said seals, wherein cut-outs are formed in the piston-like part, in the central valve housing and in the cylinder head part and lead to said seals in order to facilitate an exchange of pump medium in annular gaps which are formed on a pressure side of the seals between a peripheral wall of the piston-like part and the cylinder head part on a low pressure side between the peripheral surface of the central valve housing and the cylinder head and the cylinder part.

13. A plunger pump in accordance with claim 12; wherein said cut-outs are housing bores formed in the piston-like part and in the central valve housing.

* * * * *